US010563858B2

(12) United States Patent
Polanowski

(10) Patent No.: US 10,563,858 B2
(45) Date of Patent: Feb. 18, 2020

(54) ATHLETIC WEAR ILLUMINATION

(71) Applicant: Timothy Ryan Polanowski, Towson, MD (US)

(72) Inventor: Timothy Ryan Polanowski, Towson, MD (US)

( * ) Notice: Subject to any disclaimer, the term of this patent is extended or adjusted under 35 U.S.C. 154(b) by 188 days.

(21) Appl. No.: 15/149,124

(22) Filed: May 7, 2016

(65) Prior Publication Data

US 2016/0348890 A1 Dec. 1, 2016

Related U.S. Application Data

(63) Continuation-in-part of application No. 14/877,847, filed on Oct. 7, 2015.

(60) Provisional application No. 62/166,650, filed on May 26, 2015.

(51) Int. Cl.

| | |
|---|---|
| ***F21V 33/00*** | (2006.01) |
| ***A41F 9/00*** | (2006.01) |
| ***H04R 1/02*** | (2006.01) |
| ***G08B 5/38*** | (2006.01) |
| ***G08B 5/36*** | (2006.01) |
| ***G08B 7/06*** | (2006.01) |
| ***F21S 4/22*** | (2016.01) |
| ***A41D 13/01*** | (2006.01) |

(52) U.S. Cl.

CPC ..... *F21V 33/0008* (2013.01); *A41D 13/01* (2013.01); *A41F 9/002* (2013.01); *F21S 4/22* (2016.01); *G08B 5/36* (2013.01); *G08B 5/38* (2013.01); *G08B 7/06* (2013.01); *H04R 1/028* (2013.01); *H04R 2201/023* (2013.01)

(58) Field of Classification Search

CPC ..... F21V 33/0008; A41D 13/01; F21S 4/22

See application file for complete search history.

(56) References Cited

U.S. PATENT DOCUMENTS

| | | | | |
|---|---|---|---|---|
| 5,381,318 | A * | 1/1995 | Fang | G01B 3/1084 33/760 |
| 5,859,628 | A * | 1/1999 | Ross | B60R 16/0315 340/990 |
| 6,745,786 | B1 * | 6/2004 | Davis | A45B 3/00 135/65 |
| 2008/0019120 | A1 | 1/2008 | Rapisarda | |
| 2011/0119812 | A1 * | 5/2011 | Genz | F21V 23/04 2/244 |

(Continued)

OTHER PUBLICATIONS

Nigel, The Wearable Technology Show 2014—a sneak preview of the current state of the art in wearable gadgets, web page, http://www.redferret.net/?p=43364, accessed Sep. 24, 2016.

(Continued)

*Primary Examiner* — Jong-Suk (James) Lee
*Assistant Examiner* — Christopher E Dunay
(74) *Attorney, Agent, or Firm* — Patent Portfolio Builders PLLC

(57) ABSTRACT

An athletic wear illumination system. The athletic wear illumination system may comprise a power pack device, and an athletic wear garment. The power pack may be configured to connect to a power pack connector and at least one illumination channel. The at least one illumination channel may be configured to consist of at least one upper layer and at least one bottom layer, where one or more lights are placed within the channel of the upper layer and bottom layer of an athletic wear garment.

20 Claims, 16 Drawing Sheets

(56) References Cited

U.S. PATENT DOCUMENTS

| | | | | |
|---|---|---|---|---|
| 2011/0199779 | A1* | 8/2011 | Chu | F21V 33/0008 362/551 |
| 2011/0305006 | A1* | 12/2011 | Hehenberger | A41D 13/01 362/103 |
| 2012/0063124 | A1* | 3/2012 | Schrimmer | A41D 27/085 362/103 |
| 2012/0170232 | A1* | 7/2012 | Bhattacharya | D03D 3/005 361/749 |
| 2013/0128555 | A1* | 5/2013 | Brauser | A01K 27/006 362/108 |
| 2015/0016095 | A1* | 1/2015 | Kretzu | A41D 1/002 362/108 |
| 2016/0223149 | A1* | 8/2016 | Gerpheide | F21L 4/00 |

OTHER PUBLICATIONS

Max Parker, Insane new 3D printed smart dress uses Intel tech to track your mood, web page, http://www.wareable.com/smart-clothing/insane-new-3d-printed-smart-dress-uses-intel-tech-to-track-your-mood, accessed Sep. 24, 2016.

Jill Duffy, Adidas Technology to Track Major League Soccer Players, web page, http://www.pcmag.com/article2/0,2817,2407383,00.asp, accessed Sep. 24, 2016.

Internet Archive Cache of http://roadwarez.com, web page, https://web.archive.org/web/20151122022512/http://roadwarez.com, accessed Sep. 24, 2016.

RoadwareZ, web page, http://roadwarez.com, accessed Sep. 24, 2016.

* cited by examiner

ATHLETIC WEAR ILLUMINATION

RELATED APPLICATION

This application is a continuation-in-part of U.S. patent application Ser. No. 14/877,847, filed Oct. 7, 2015, and entitled "ATHLETIC WEAR ILLUMINATION", which is a non-provisional application of prior U.S. Provisional Patent Application Ser. No. 62/166,650, filed May 26, 2015, and entitled "ATHLETIC WEAR ILLUMINATION", each of which is herein incorporated by reference in its entirety.

BACKGROUND

1. Field

Embodiments of the present invention relate generally to the field of garments and particularly to illuminated athletic wear used by runners, bikers, and other non-contact sport athletes.

2. Description of the Related Art

Many exercise enthusiasts do not have the ability to dictate the time of the day for which they workout. This may be due to multiple factors including work schedule requirements, commute times, and even environmental considerations. For example, many work traditional work hours and have long commute times to and from work. Still others may live in a relatively hot environment where it is difficult to run during the heat of the day. In each of these situations, athletes may have no alternative other than to exercise at night. Also, there may be places and/or events where the lack of lighting is not optimal for the safety of the athlete. Athletic wear is typically designed principally with comfort of the athlete in mind. For example, running pants may be designed to be lightweight and to pull moisture away from the skin. Accordingly, running pants are often tight fitting and made of a stretchable moisture wicking material. Many current offerings are black or a dark gray which may be difficult for others to see at night. Dark color offerings are certainly not the rule, and in fact there are many offerings that are designed with style in mind (e.g., having stylish patterns and bright colors). However, even these stylish and colorful running pants may be difficult for others to see at night. If others (e.g., such as those operating automobiles) are unable to clearly see an athlete running at night, then there is an increased safety risk for the athlete.

In light of the foregoing and other shortcomings in the art, it is desirable to provide improved athletic wear.

BRIEF SUMMARY

It is an aspect of the present invention to provide illuminated athletic wear.

In accordance with an aspect of the present invention, an athletic wear illumination system may be provided. The athletic wear illumination system may comprise a power pack and an athletic wear garment. The power pack may include one or more batteries to power one or more lights external to the power pack, a controller configured to control illumination of the one or more lights, and one or more contacts for electrically connecting the one or more batteries of the power pack to the one or more lights. The athletic wear garment may include at least one illumination channel defined by a transparent or semitransparent upper layer and a fabric bottom layer. The at least one illumination channel may be configured to receive the one or more lights. The athletic wear garment is configured to removably receive the power pack.

The power pack may further comprise a panic selection. Upon activation of the panic selection, the controller is further configured to illuminate the one or more lights in a flashing pattern and/or combination of colors indicative of athlete distress.

The power pack may further comprise one or more speakers. Upon activation of the panic selection, the controller may be further configured to cause the one or more speakers to emit an alarm and/or siren in conjunction with the illumination of the one or more lights in the flashing pattern and/or combination of colors indicative of athlete distress.

The power pack may further comprise a mobile device interface. The controller may be further configured to interface with a Global Positioning Satellite (GPS) enabled mobile device to log and/or transmit GPS coordinates of the mobile device upon selection of the panic button.

The athletic wear garment may further include a power pack pocket including one or more electrical connectors and one or more fasteners configured to secure the power pack when removably received by the athletic wear garment.

The one or more lights may be part of a light strip.

The light strip may be sewn or affixed as a layer between the transparent or semitransparent upper layer and the fabric bottom layer.

The fabric bottom layer may be constituted by a fabric of the athletic wear garment.

The athletic wear garment may further comprise reflective trim.

The foregoing and other aspects will become apparent from the following detailed description when considered in conjunction with the accompanying drawing figures.

DESCRIPTION

Figure 1:
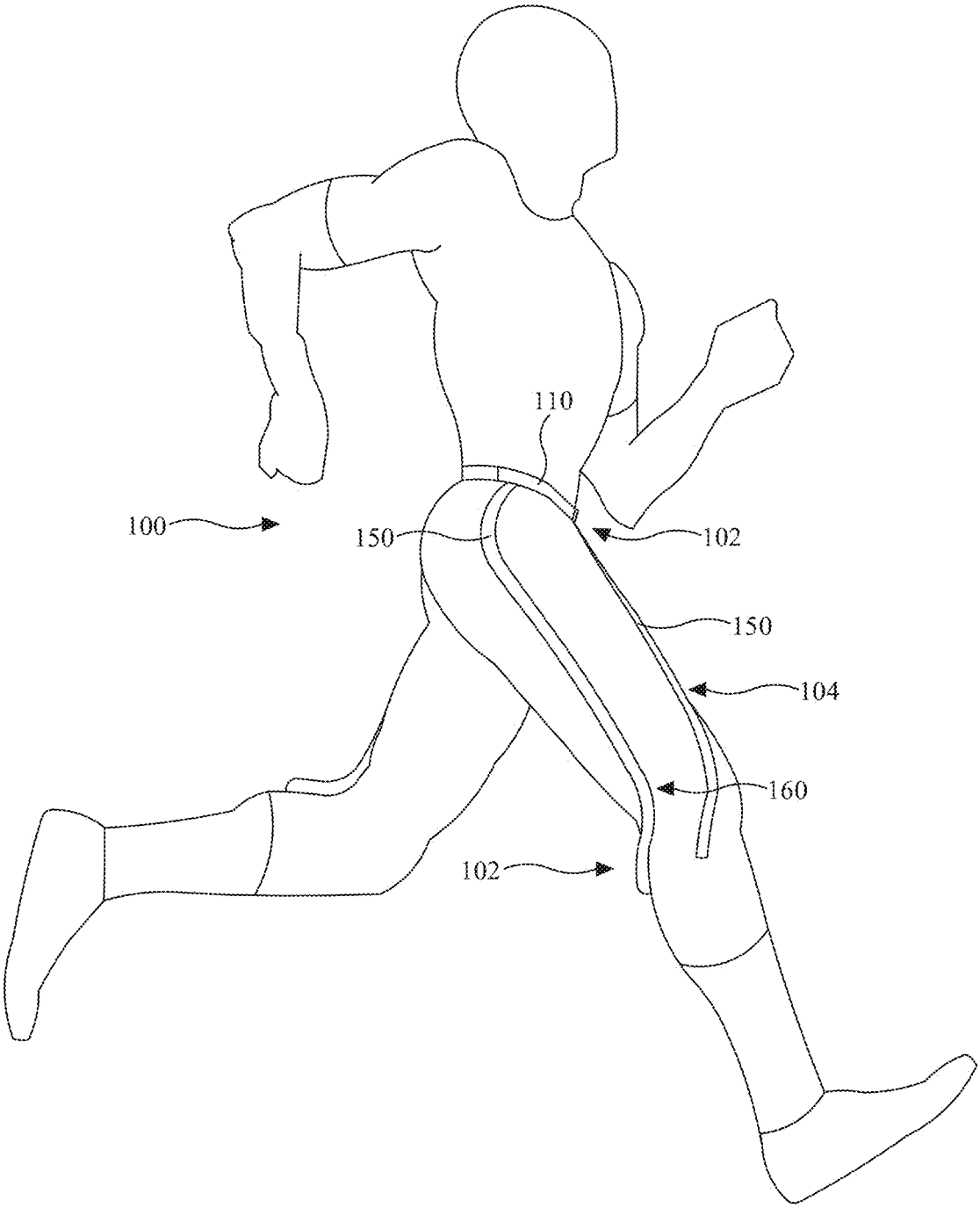
FIG. 1 is a side view of an athletic wear illumination system according to an embodiment of the present invention.

Reference will now be made in detail to embodiments of the present invention, examples of which are illustrated in the accompanying drawings, wherein like reference numerals refer to the like elements throughout. The embodiments are described below to explain the present invention by referring to the figures.

As used in the description of this application, the terms "a", "an" and "the" may refer to one or more than one of an element (e.g., item or act). For example, references to "a track" may refer to one or more tracks. Similarly, a particular quantity of an element may be described or shown while the actual quantity of the element may differ. The terms "and" and "or" may be used in the conjunctive or disjunctive sense and will generally be understood to be equivalent to "and/or". Elements from an embodiment may be combined with elements of another. For example, aspects of the power pack of FIG. 11 may be incorporated into the belt illumination device of FIG. 1, and vice versa. No element used in the description of this application should be construed as critical or essential to the invention unless explicitly described as such. Further, when an element is described as "connected," "coupled," or otherwise linked to another element, it may be directly linked to the other element, or intervening elements may be present.

In accordance with embodiments of the present invention, athletes having to run, bike, walk, or otherwise exercise at night may illuminate their athletic wear such that the athletic wear remains comfortable, affordable, and washable. According to an embodiment of the present invention, an athletic wear illumination system may be provided. The athletic wear illumination system may include a belt-illumination device and a track-mounted lower body garment. The belt-illumination device may include a belt and at least one illumination strand extending from the belt, said at least one illumination strand being adapted to be received within a corresponding at least one track attached to the track-mounted lower body garment. The track-mounted lower body garment may comprise athletic pants or shorts having the at least one track attached thereto, said at least one track being adapted to receive the illumination strand of the belt illumination device. The belt-illumination device and track-mounted lower body garment may be provided in different sizes including different waist sizes and lengths.

In an embodiment, the belt-illumination device may include four illumination strands and the track-mounted lower body garment may include four tracks corresponding to the four illumination strands. Once the belt illumination device is attached at the waist of an athlete, the athlete may easily guide the four illumination strands of the belt-illumination device into or onto the four tracks of the track-mounted lower body garment. Accordingly, the athletic wear illumination system may provide a system whereby illumination strands of a belt may be attached to the track-mounted lower body garment. After the athlete is finished exercising, the athlete may unfasten the belt illumination device and by pulling the device away from the waist, the four illumination strands may easily come out of or off of the four tracks. The belt-illumination device may be interchangeable with various track-mounted lower body garments. Similarly, the track-mounted lower body garment may be interchangeable with various belt-illumination devices.

According to another embodiment, an athletic wear illumination system may be provided. The athletic wear illumination system may include a power pack and an athletic wear garment. The power pack may include one or more batteries to power one or more lights external to the power pack, a controller configured to control illumination of the one or more lights, and one or more contacts for electrically connecting the one or more batteries of the power pack to the one or more lights. The athletic wear garment may include at least one illumination channel defined by a transparent or semitransparent upper layer and a fabric bottom layer. The at least one illumination channel may be configured to receive the one or more lights. The athletic wear garment is configured to removably receive the power pack.

Figure 2:
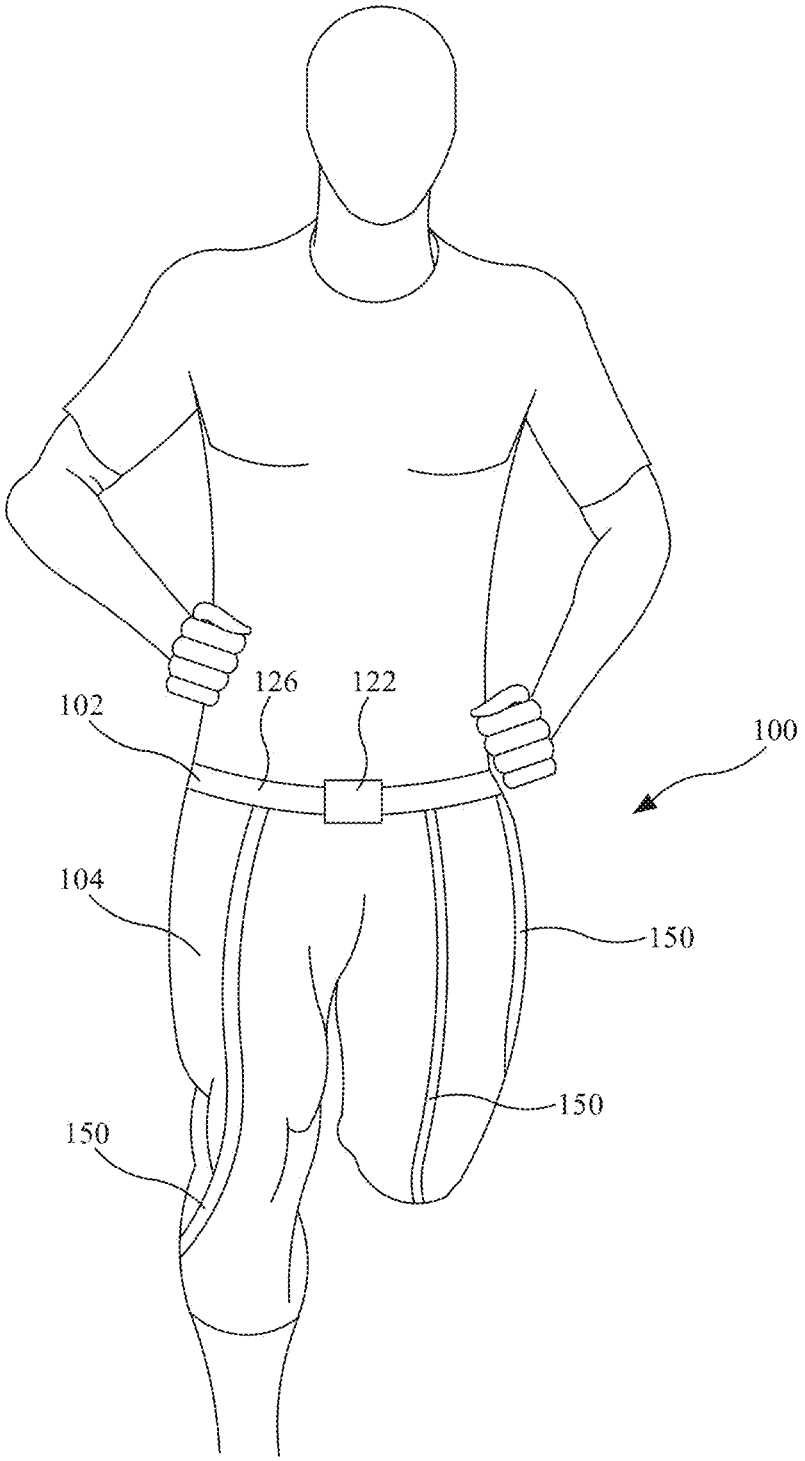
FIG. 2 is a partial front view of the athletic wear illumination system of FIG. 1.
Figure 3:
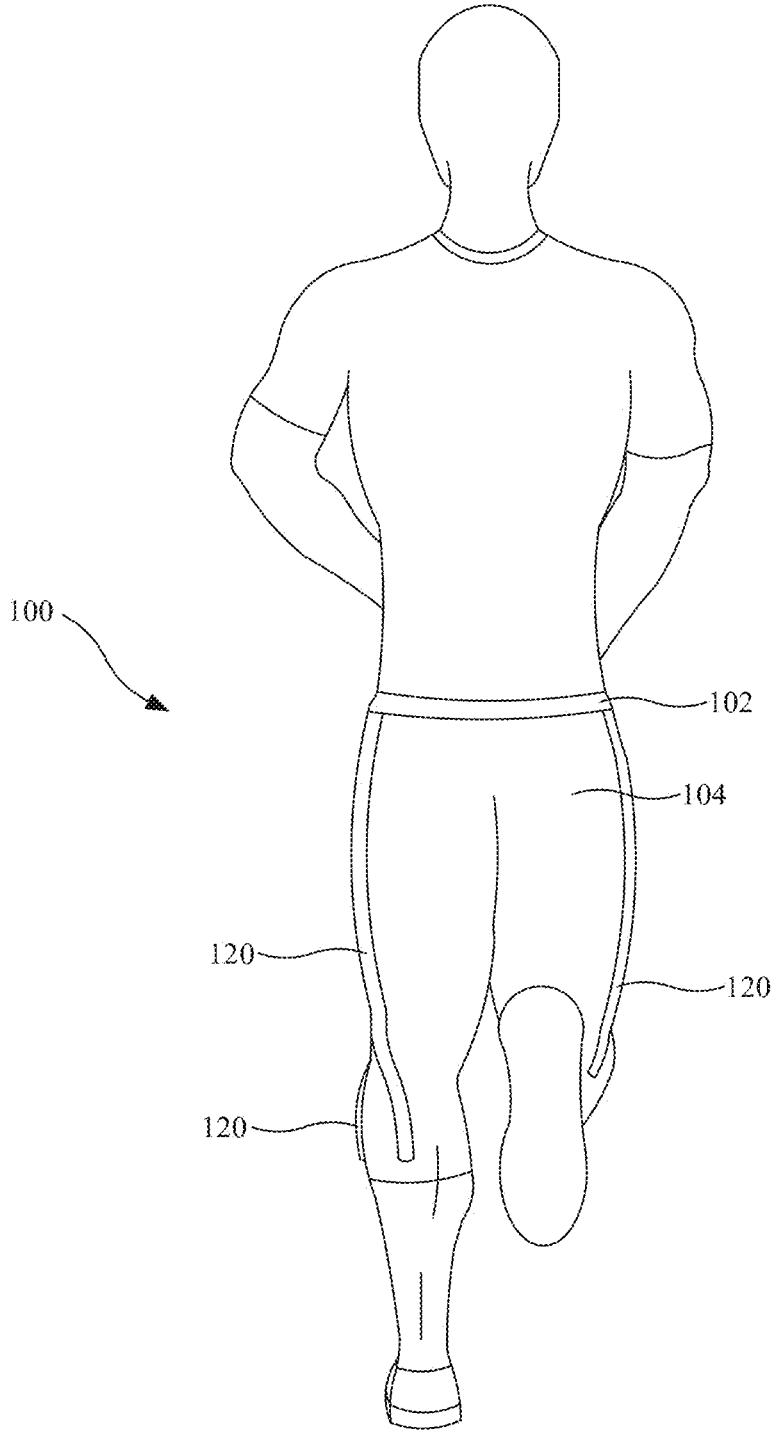
FIG. 3 is a rear view of the athletic wear illumination system of FIG. 1.

FIG. 1 is a side view an athletic wear illumination system 100 according to an embodiment of the present invention. FIG. 2 is a partial front view of the athletic wear illumination system 100 of FIG. 1. FIG. 3 is a rear view of the athletic wear illumination system 100 of FIG. 1. With references to FIGS. 1-3, the athletic wear illumination system 100 may include a belt illumination device 102 and a track-mounted lower body garment 104. The belt illumination device 102 may include a belt and at least one illumination strand 120 (FIG. 4) extending from the belt. In the embodiment shown, the belt illumination device 102 includes four illumination strands. By including four illumination strands 120 arranged within tracks 150 of the track-mounted lower body garment 104 as discussed below, visibility of an athlete wearing the athletic wear illumination system 100 from four sides (i.e., 360 degrees) can be achieved.

The track-mounted lower body garment 104 may comprise athletic pants or shorts (e.g., running pants or shorts) having at least one track 150 attached thereto. In the embodiment shown, the track-mounted lower body garment 104 is a pair of ¾ running pants including four tracks. However, alternative configurations are considered to be within the scope of the present invention. For example, the track-mounted lower body garment 104 may be a pair of running shorts or full length pants, and may have an alternative number of tracks such as two tracks. The track-mounted lower body garment 104 may be made from a stretchable moisture wicking material or other suitable material. For example, the track-mounted lower body garment 104 may be formed from one or more of polyester, spandex, nylon, cotton, or other suitable materials. The track-mounted lower body garment 104 may be washable and dryable in a household clothes washer and dryer.

Figure 7A:
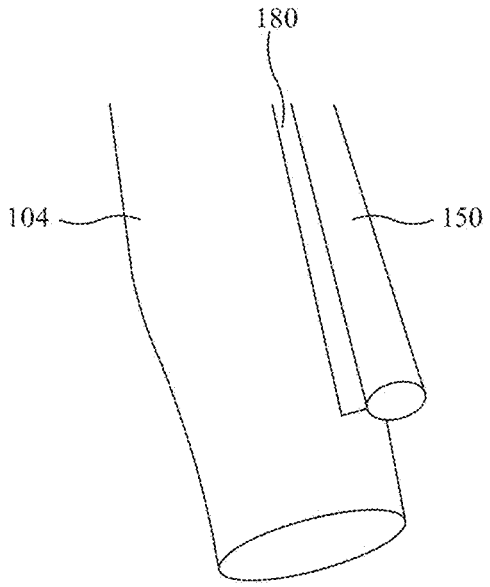
FIGS. 7A-7D are partial views of tracks according to exemplary embodiments of the present invention.

The tracks 150 may be adapted to receive the illumination strands 120 of the belt illumination device 102. In this way, the belt illumination device 102 may be attached to the track-mounted lower body garment 104. Turning to FIG. 7A, which is a partial view of a track 150 according to an embodiment of the present invention, the tracks 150 may be attached to the track-mounted lower body garment 104. In the embodiment shown, the track 150 includes a channel formed from rubberized plastic. The track may be ⅜ inch wide, though one of skill in the art will appreciate that this may vary depending on the size of the illumination strand. The channel may be open at both ends (at or near a beltline of the track-mounted lower body garment 104 and at a bottom end of the channel). However, alternative configurations are considered to be within the scope of the present invention. For example, the bottom end of the channel may be closed. The channel may be transparent or semi-transparent so as to allow light to pass through the channel. Alternative channel designs are contemplated and are considered to be within the scope of the present invention. For example, a channel may be formed of fabric that lets light pass through. In yet another alternative embodiment, a channel may be formed of transparent or translucent tubing. In yet another alternative embodiment, a channel may be formed of a screen material. In yet another alternative embodiment, a color tinted transparent or semitransparent channel may be provided to cooperate with a white or clear illumination strand.

The channel may be fastened to the track-mounted lower body garment 150, directly, or by a connecting member 180. In the embodiment shown, the channel is permanently attached to the track-mounted lower body garment 150 by sewing the channel to a fabric strip connecting member 180 that runs the length of the channel, and by sewing the fabric strip connecting member 180 to the track-mounted lower body garment 104. By incorporating the fabric strip connecting member 180 in-between the channel and the track-mounted lower body garment 104, the track 150 may be less restrictive to the athlete during use, even when the track 150 contains a corresponding illumination strand 120. Further, the fabric strip connecting member 180 may allow the fabric of the track-mounted lower body garment to stretch without stretching the channel of the track 150. In the embodiment shown, the fabric strip connecting member 180 may be formed of the same material as the track-mounted lower body garment 104 and may be ⅜ inch wide, though other sizes are considered to be within the scope of the present invention. Although a particular channel/connecting member/garment construction has been disclosed, alternative configurations are considered to be within the scope of the present invention. For example, a channel may be affixed directly to the track-mounted lower body garment. In yet another alternative embodiment, a plurality of fastening strips (such as hook and loop fastening strips) may be used to fasten a channel to the track-mounted lower body garment, or to directly fasten the illumination strand to the track-mounted lower body garment (in which embodiment the plurality of fastening strips may constitute the channel). Turning back to the channel/connecting member/garment arrangement, the channel and the connecting member may be referred to herein collectively as the track 150.

Figure 7B:
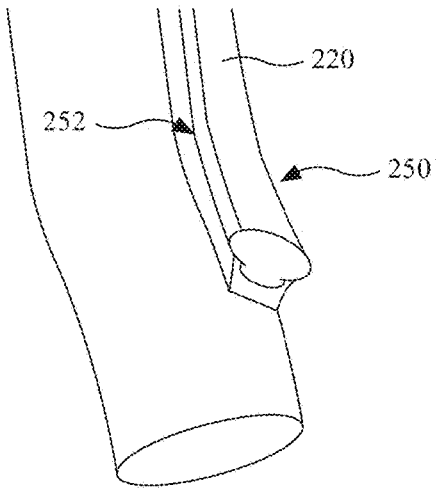
Figure 8A:
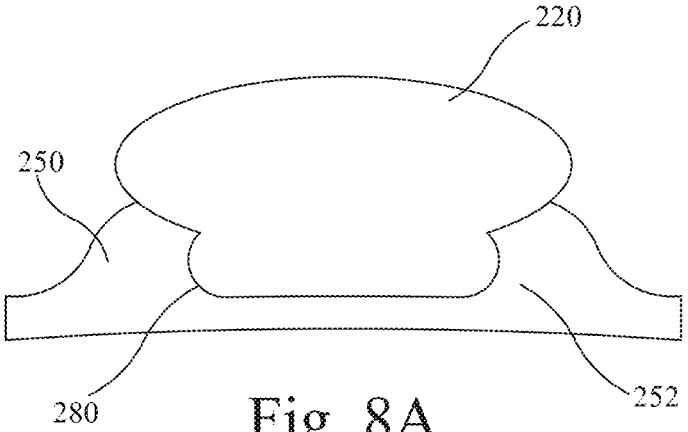
FIGS. 8A and 8B are cutaway views of tracks according to exemplary embodiments of the present invention.
Figure 8B:
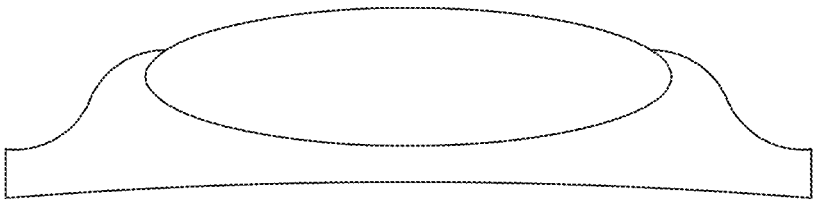

FIG. 7B is a partial view of a track 250 according to another embodiment of the present invention. FIG. 8A is a cutaway view of the track 250 of FIG. 7B with an illumination strand 120 received therein. The track 250 may be attached to the tracked-mounted lower body garment 104. In the embodiment shown, the track 250 includes a dove-tail channel 252 formed of rubberized plastic. Because the track 250 may be formed of rubberized plastic, the track 250 may be flexible. In one embodiment, the track may be formed of a mix of polypropylene and ethylene propylene diene monomer rubber. In another embodiment, the track may be formed of thermoplastic vulcanizate. In yet another embodiment, the track may be formed of thermoplastic polyolefin. In yet another embodiment, the track may be formed of chlorinated neoprene. As shown in FIG. 8A, the dove-tail channel may be ¼ to ½ inches wide internally, ⅜ to ⅝ inches tall, and of a convex or semi-circular shape, though one of skill in the art will appreciate that this may vary depending on the size and shape of the illumination strand. For example, as shown in FIG. 8B, the dove-tail channel may be ½ to ¾ inches wide internally, ¾ to 1¼ inches wide externally, and ⅜ to ⅝ inches tall. The illumination strand may be may be formed of a clear flexible material and include a dove-tail feature 280 corresponding to the dove tail channel 252 such that the illumination strand may mate to the track 250. Alternative sizes, shapes, and configurations are contemplated and are considered to be within the scope of the present invention. For example, a track may have an oblong shape and a track may have a corresponding channel.

The track 250 may be fastened to the track-mounted lower body garment 104 (204), directly, or by a connecting member (not shown). In the embodiment shown, the track 250 is permanently attached to the track-mounted lower body garment 104 by sewing the track 250 directly to the track-mounted lower body garment 104. As noted above, the track 250 may be formed of rubberized plastic and may therefore be flexible.

Figure 7C:
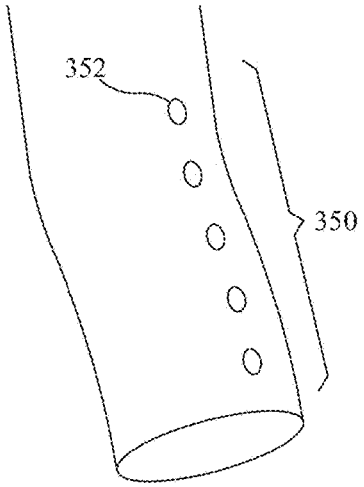
Figure 7D:
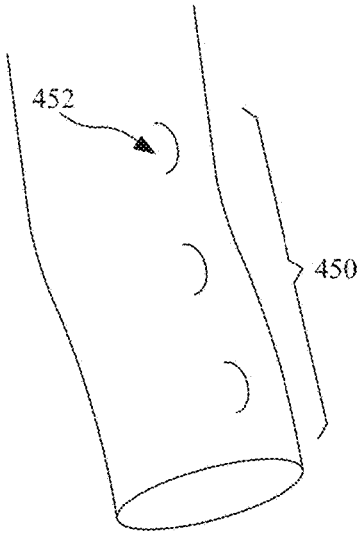

FIGS. 7C and 7D are partial views of tracks 350 and 450 according to further alternative embodiments of the present invention. The track 350 of FIG. 7C may be formed of a plurality of receptacles 352 while the track 450 of FIG. 7D may be formed of a plurality of magnets 452. In an embodiment, the receptacles 352 may be configured to receive a series of plastic clips molded with or otherwise attached to an illumination strand. In an alternative embodiment, the receptacles 352 and clips may constitute snap fasteners, that is, pairs of interlocking discs. Turning to FIG. 7D, the plurality of magnets 452 may be embedded within the track-mounted lower body garment 104. In the embodiments shown in FIGS. 7C and 7D (and their alternatives), the buttons may be spaced an appropriate distance apart from one another and in a desire line (e.g., having one or more desired curves so as to provided desired visibility for the athlete.

In the embodiment shown, the track-mounted lower body garment 104 may include two pant legs extending from the users hips to midway down the user's calf, and a waist section that extends from the waist to where the two pant legs start. The at least one track 150 may be placed intentionally for athlete comfort and for increasing visibility of the athlete to others. In the embodiment shown, four tracks 150 are shown. Each of the four tracks 150 starts from below a beltline of the track-mounted lower body garment and each may run downward from below the beltline, as described below after the belt illumination device 102 is described.

Figure 4:
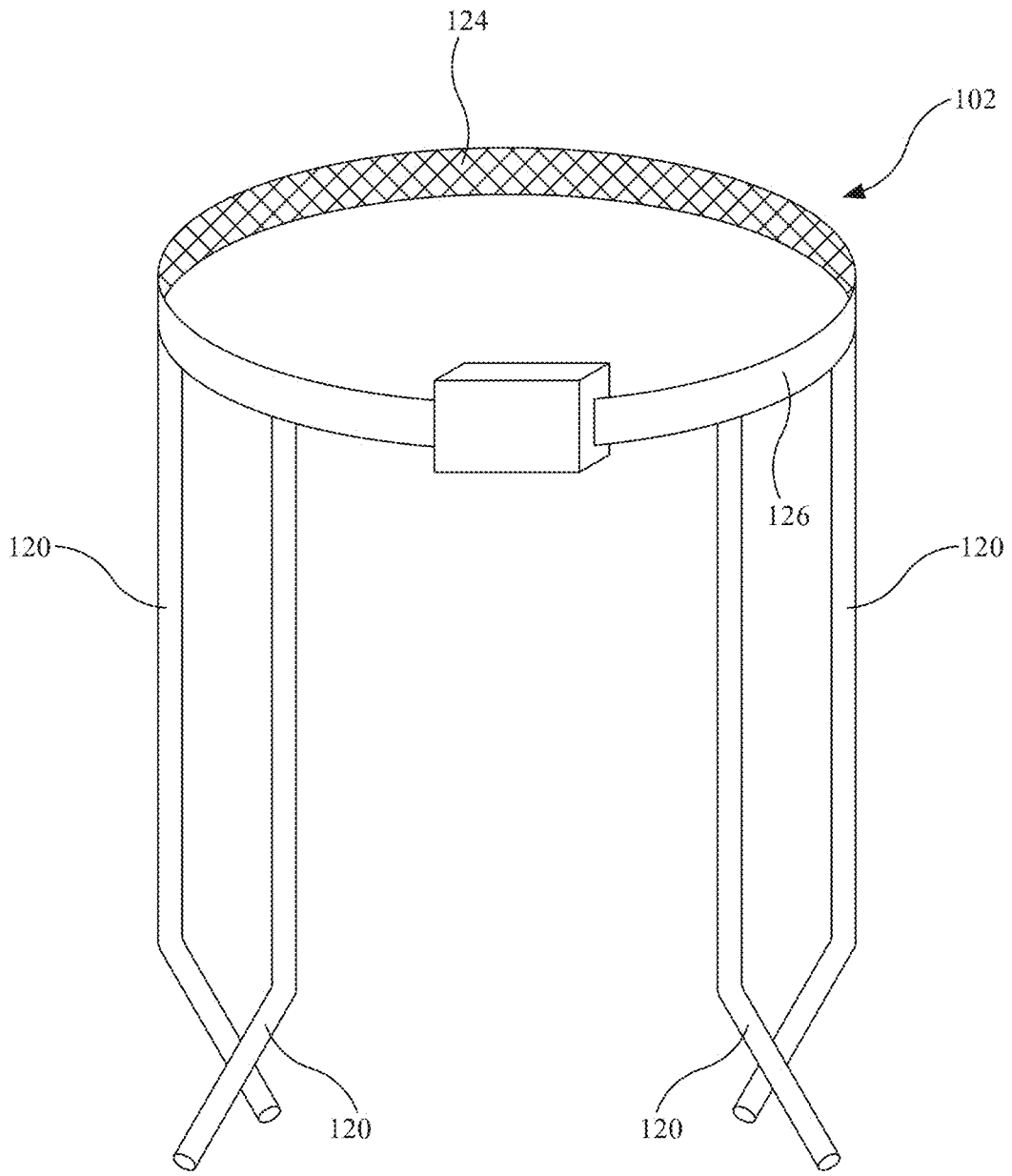
FIG. 4 is a front view of a belt illumination device according to an embodiment of the present invention.
Figure 5:
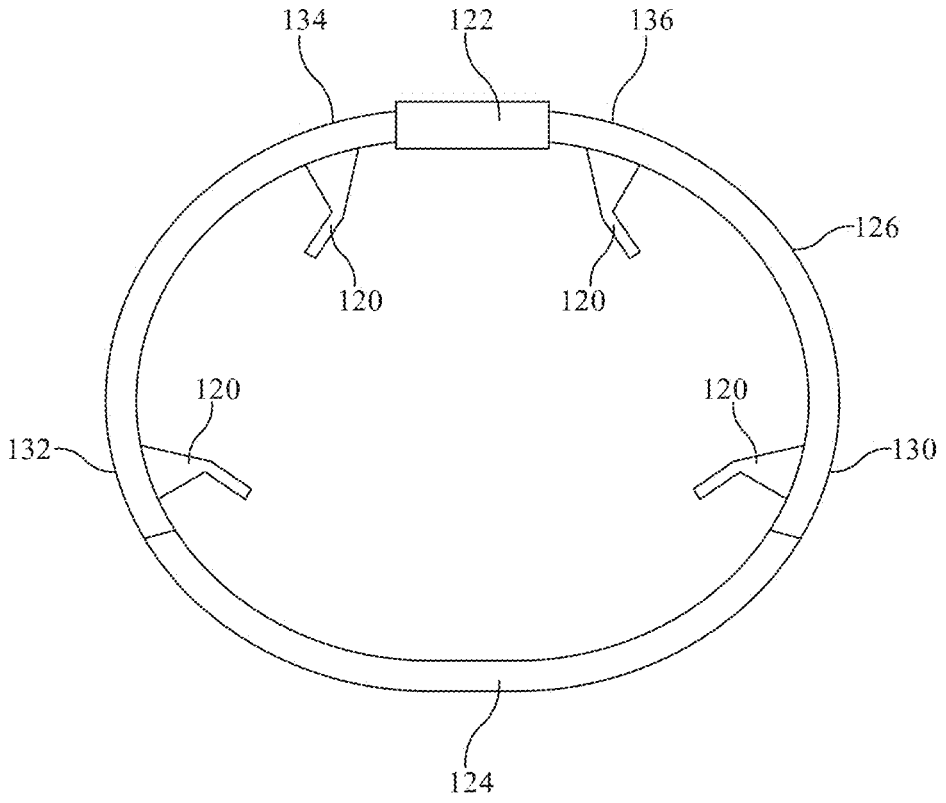
FIG. 5 is a top view of the belt illumination device of FIG. 4.

FIG. 4 is a front view of a belt illumination device 102 according to an embodiment of the present invention. FIG. 5 is a top view of the belt illumination device of FIG. 4. In the embodiment shown, the belt illumination device 102 includes a buckle 122, a belt, and at least one illumination strand 120. One of ordinary skill in the art will appreciate that the belt of the belt illumination device 102 is depicted in a circular shape in FIG. 5 for the sake of discussion, but that in operation, the belt will take the shape of its user. In the embodiment shown, the belt comprises a stretch portion 124 and two non-stretch portions 126. However, alternative configurations are considered to be within the scope of the present invention. For example, the belt may comprise a single portion, two portions (as described below with respect to the embodiment of FIG. 6), or more portions. The belt may include the stretch portion in addition to the non-stretch portion so that the belt illumination device 102 may be worn comfortably and snug at the waist without requiring belt loops (though an embodiment of a track-mounted lower body garment including belt loops is considered to also be within the scope of the present invention). In another embodiment, a belt portion that is a partial belt may be provided.

In the embodiment shown in FIGS. 4 and 5, a first of the non-stretch portions 126 may extend from a position behind (e.g., relative to the buckle 122, ½ inch behind) where one of the rear illumination strands 120 extends from the non-stretch portion 126 to the buckle 122. A second of the non-stretch portions 126 may extend from the buckle 122 to a position beyond where another one of the rear illumination strands 120 extends from the non-stretch portion 126. The stretch portion 124 may extend from the first non-stretch portion 126 to the second non-stretch portion on the back side of the belt. In other words, the stretch portion 124 may extend on the rear of the belt from a position before (e.g., from a position ½ inch before) where one of the rear illumination strands extends from the first non-stretch portion 126 to a position before (e.g., from a position ½ inch before) where anther one of the rear illumination strands extends from the second non-stretch portion. The non-stretch portions 126 may be formed of a rubberized plastic. The stretch portion 124 may be formed of an elastic material (e.g., a rubber material with or without a fabric surrounding the rubber material) to ensure fit and comfort of the belt for the user. However, alternative configurations are considered to be within the scope of the present invention. For example, the non-stretch portions may be formed of a hard plastic, or woven cotton and the stretchable portion may be formed of an alternative stretchable material. The non-stretch and/or stretch portions may be substituted with a semi-flexible molded rubber and include wiring therein. Such an embodiment may be flexible to the precise shape of the athlete's body, but also provide a structure for wiring between a power supply and the illumination strands.

In the embodiment shown, the belt illumination device 102 including the belt and the at least one illumination strand 120 are formed as a unitary structure. For example, the illumination strands may be attached to the belt by means of a fastener or alternatively by adhesive. As yet another alternative, the illumination strands may be attached to the belt by means of a friction fit. As yet additional alternatives, the illumination strands may be attached by means of sewn, melted, in situ molded, to the non-stretch portions of the belt. However, alternative configurations are considered to be within the scope of the present invention. For example, the belt illumination device may include at least one illumination strand that is removable from the belt portion such as via a plug and/or fastener assembly. In one embodiment, axial plugs with a retaining structure such as a clip may be provided. Alternatives such as spring devices, snaps, magnetic connectors or other connection methods may be employed.

The buckle 122 may contain one or more batteries. The buckle may be weatherproof. The buckle may be formed of a rubberized and/or hard plastic. In the embodiment shown, four 2016 (e.g., CR2016) lithium batteries may be arranged 2×2 side by side thereby supplying 12 volts. However, alternative configurations are considered to be within the scope of the present invention. For example, one or more non-lithium batteries may be used, as may other types of lithium batteries providing the same or other levels of voltage (e.g., 6 volts). In general, a specific power source may be determined by balancing a desire for less weight (so as to not hinder the motion and comfort of the athlete) against the need to effectively illuminate the illumination strands and a desire for longer battery life (thereby requiring less charging). In yet another embodiment, a motion power generator is used to generate power from the motion of the athlete in place of batteries. The shape of the buckle shown is rectangular, however: any shape suitable for housing the batteries may be employed.

The batteries may be operably connected to the at least one illumination strand 120. In the embodiment shown, the batteries may be operably connected to the illumination strands 120 via, e.g., encased 18-22 gauge stranded copper wires (or other appropriate size and material wire) extending through the non-stretch portions 126 of the belt to the light strands 120. Elements such as the illumination strand may be connected to the wire by flux and solder or other appropriate connection types, and may be covered by a rubberized protection to reduce the chance of an electrical short due to athlete sweat or weather. In the embodiment shown, the wires may be embedded within the non-stretch portions 126 of the belt. In the embodiment shown, the buckle 122 may be permanently or fixedly attached to either the first or second non-stretch portion 126 and adapted to be operably connected to the other. For example, the buckle 122 may include a female member to receive a male member of one of the non-stretch portions 126. When fastened together, the female and male member may include metal contacts to connect the wire extending through the non-stretch portion 126 to the batteries in the buckle 122.

In between the at least one illumination strand and the batteries, a switch may be provided for interrupting supply of power from the battery pack to the at least one illumination strand thereby allowing the illumination strand to be switched on or off. In an alternative embodiment, a photocell (or other light sensor) may be provided to detect a level of light and automatically interrupt supply of power from the battery pack to the illumination strands when the level of light is at or above a predetermined level and/or supply of power when the light level is at or below the predetermined level. Accordingly, the photocell may provide an automatic switch option for switching on or off the illumination strands. Additional functionality such as patterned blinking and/or multi-color may be provided by additional switches and/or one or more controllers. In yet another alternative embodiment, the illumination strand may be illuminated for a period and then turned off for a period so as to save battery power. For example, the illumination strand may blink for one second and then dim or turn completely off for two seconds.

The at least one illumination strand 120 may comprise a string or line of Light Emitting Diode (LED) lights. In the embodiment shown, the LED lights may be rounded with a ¼ inch diameter. However, alternative configurations are considered to be within the scope of the present invention. For example, in an alternative embodiment, fiber optic lights may be provided. In yet another alternative embodiment, electroluminescent lighting (EL) may be provided. In the embodiment shown, the at least one illumination strand may comprise clear LED lights. However, alternative configurations are considered to be within the scope of the present invention. For example, the LED lights may be colored or multi-colored. In yet another alternative embodiment, the switch and/or controller may enable blinking or other on-off patterns of illumination and the LED lights may include a red color mode. Together, the blinking of the red LED lights may correspond to an emergency mode whereby a user sets the switch to the emergency mode to indicate medical or other distress.

The belt illumination device 102 is shown in FIG. 5 with indications at a 3 o'clock position 130, a 9 o'clock position 132, an 11 o'clock position 134, and a 1 o'clock position 136. In the embodiment shown, a first one of the rear illumination strands 120 extends from the belt at the 3 o'clock position 130, a second extends from the belt at the 9 o'clock position 132, a third at the 11 o'clock position 134, and a fourth at the 1 o'clock position 136.

Figure 6:
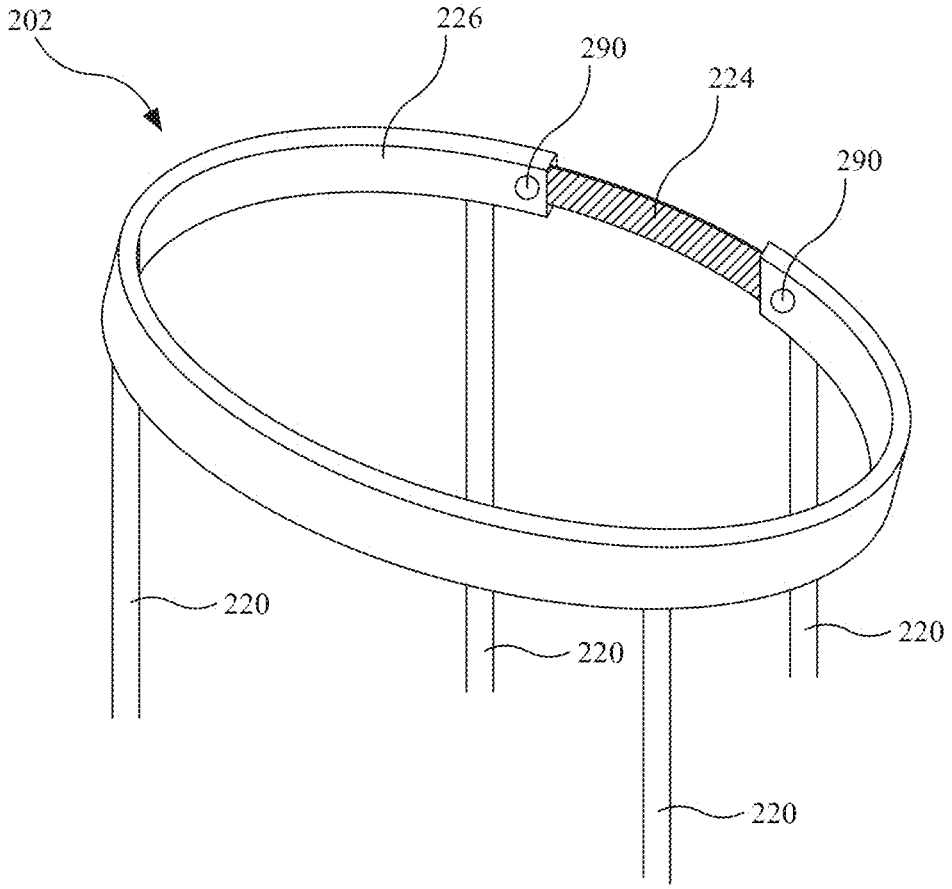
FIG. 6 is a perspective view of a belt illumination device according to another embodiment of the present invention.

FIG. 6 is a perspective view of a belt illumination device 202 according to another embodiment of the present invention. The belt illumination device 202 may be similar to belt illumination device 102. In the interest of brevity, similar aspects and alternatives will not be repeated. In the embodiment of FIG. 6, the belt illumination device 202 may include a stretch portion 224 and a non-stretch portion 226. The stretch portion 224 may extend on a rear of the belt from one end of the non-stretch portion 226 to the other end of the non-stretch portion 226. In the embodiment shown, the non-stretch portion 226 may extend from a position behind (relative to the front of the belt) where one of the rear illumination strands 220 extends from the non-stretch portion 226 to a position beyond where the other rear illumination strands 220 extends from the non-stretch portion. A difference between the embodiment of FIGS. 4 and 5, and the embodiment of FIG. 6, is that the embodiment of FIG. 6 does not include a buckle. Instead of using a buckle to take off and put on the belt illumination device 202, a user may un-attach one end and/or the other of the stretch portion from the non-stretch portion. In the embodiment of FIG. 6, a user may depress tab 290 thereby unfastening the stretch portion from the non-stretch portion. Another difference between the embodiment of FIGS. 4 and 5, and the embodiment of FIG. 6 is that the non-stretch portion 226 may contain the one or more batteries. Finally, the belt illumination device 202 of FIG. 6 is shown with illumination strands at a 2 o'clock position, a 5 o'clock position, a 7 o'clock position, and a 10 o'clock position. It should be appreciated by one of ordinary skill in the art that where the belt illumination device includes at least one illumination strand that is removable from the belt portion such as via the plug and/or fastener assembly, the particular location of attachment of the illumination strand may be athlete configurable. In this way, an athlete may use the belt illumination device with garments having different track locations (e.g., 1, 3, 9, and 11 o'clock positions, and also 2, 5, 7, and 10 o'clock positions, or other appropriate positions). In such an embodiment, the athlete may simply plug-in or attach the illumination strands to the correct receptacles or ports on the belt portion of the belt illumination device. In an alternative embodiment, a design of the illumination device may include a power supply to be worn on the small of the back of the athlete.

Turing back to the track-mounted lower body garment 104, the embodiment shown in FIG. 1 includes four tracks 150. A first one of the tracks begins under a beltline at a 3 o'clock position corresponding to the 3 o'clock position 130 of the belt (of FIGS. 4 and 5). A second one of the tracks begins under the beltline at a 9 o'clock position corresponding to the 9 o'clock position 132 of the belt. A third one of the tracks begins under the beltline at an 11 o'clock position corresponding to the 11 o'clock position 134 of the belt. A fourth one of the tracks begins under the beltline at a 1 o'clock position corresponding to the 1 o'clock position 136 of the belt. In the embodiment shown, the first one of the tracks 150 is attached to the track-mounted lower body garment 150 and runs down the right leg on a side of the leg to a location 160 just above a side of a right knee portion of the track-mounted lower body garment 104. At the location 160 just above the side of the right knee portion, the first one of the tracks 150 curves to the rear of the leg and continues down the back of a calf area 162 of the track-mounted lower body garment 104. In the embodiment shown, the first one of the tracks 150 runs from below the beltline to an inch above the bottom of the garment 104. However, alternative configurations are considered to be within the scope of the present invention. For example, the first and/or others of the tracks 150 may run to a location above the location 160 just above the side of the right knee thereby removing the disclosed curve. In an embodiment where the track-mounted lower body garment 104 comprises running shorts, such a configuration where tracks run to a position above a user's knee may be necessary. Turing back to the embodiment shown, the second one of the tracks 150 is attached to the track-mounted lower body garment 104 and runs down the left leg on a side of the leg to a location just above a side of the left knee portion of the track-mounted lower body garment 104. At the location just above the side of the left knee portion, the second one of the tracks 150 curves to the rear of the leg and continues down the back of a calf area of the track-mounted lower body garment 104. In the embodiment shown, the second one of the tracks 150 runs from below the beltline to an inch above the bottom of the garment 104. The third one of the tracks 150 is attached to the track-mounted lower body garment 104 and runs down a front of the left leg to a location just above a front of the left knee portion of the track-mounted lower body garment 104. At the location just above the front of the left knee portion, the third one of the tracks 150 curves to the side of the leg and continues down the side of the calf area of the track-mounted lower body garment 104. In the embodiment shown, the third one of the tracks 150 runs from below the beltline to an inch above the bottom of the garment 104. The fourth one of the tracks 150 is attached to the track-mounted lower body garment 104 and runs down a front of the right leg to just above a front of the right knee portion of the track-mounted lower body garment 104. At the location just above the front of the right knee portion, the fourth one of the tracks 150 curves to the side of the leg and continues down the side of the calf area of the track-mounted lower body garment 104. In the embodiment shown, the fourth one of the tracks 150 runs from below the beltline to an inch above the bottom of the garment 104.

Figure 9:
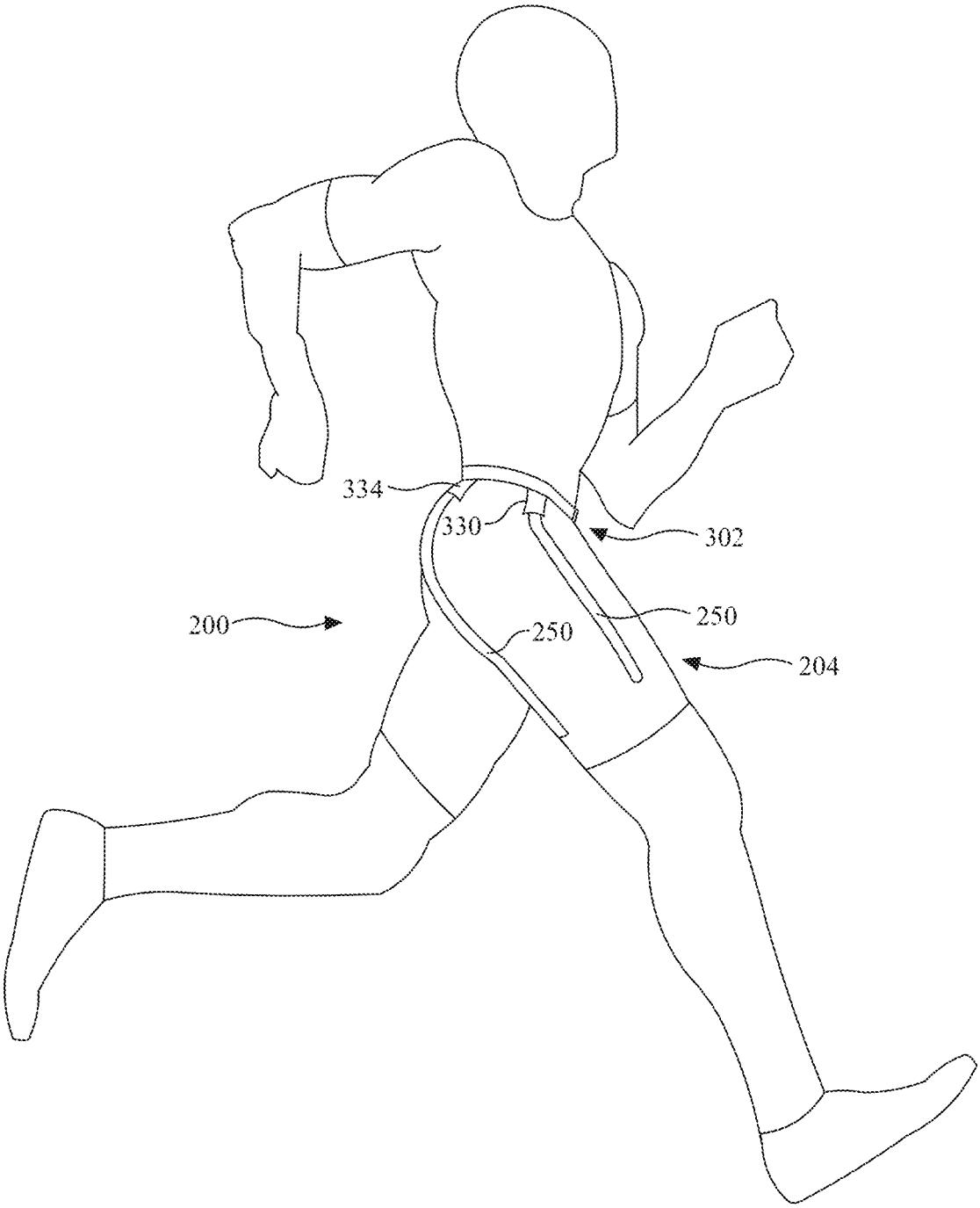
FIG. 9 is a side view of an athletic wear illumination system according to another embodiment of the present invention.

FIG. 9 is a side view of an athletic wear illumination system 200 according to another embodiment of the present invention. The athletic wear illumination system 200 may be similar to the athletic wear illumination system 100 of FIG. 1. In the interest of brevity, similar aspects and alternatives will not be repeated. In the embodiment of FIG. 9, the athletic wear illumination system 200 may include a belt illumination device 302 (FIG. 10) and a track-mounted lower body garment 204. As noted above, the belt illumination device 302 shown may include four illumination strands 320 (FIG. 10) at a 2 o'clock position, a 5 o'clock position, a 7 o'clock position, and a 10 o'clock position of the belt. The track-mounted lower body garment 204 shown in FIG. 9 is a pair of athletic running shorts including four tracks 250. The tracks 250 may include a dove-tail channel 252 such as that shown in FIG. 7B. The dove-tail channel 252 may be adapted to receive the illumination strands 320 of the belt illumination device 302 thereby attaching the illumination device 302 to the track-mounted lower body garment 204. The tracks 250 may run from a few inches (e.g., 1-6 inches) below the beltline of the track-mounted lower body garment 204 down the sides of the lower body garment. In operation, an athlete may put on the track-mounted lower body garment 204 and then put on the belt illumination device 302. The illumination strands 320 may then be easily pressed onto (e.g., in) the dove-tail channels 252 of the tracks 250. After the athlete is finished exercising, the athlete may unfasten the belt illumination device and by pulling the device away from the waist, the illumination strands may come off of (out of) the dove-tail channels 252.

As with the track-mounted lower body garment 104 of FIG. 1, the current embodiment may include tracks 250 placed intentionally for athlete comfort and for increasing visibility of the athlete to others. In contrast to the embodiment of FIG. 1, the tracks 250 may run down the legs of the track-mounted lower body garment 204 without any curves. However, alternative configurations are considered to be within the scope of the present invention. For example, with biking, a certain motion of the legs and knees may differ from the motion of the legs and knees of an athlete that is running. Accordingly, the tracks may include a curve on the leg that allows for such motion.

Figure 10:
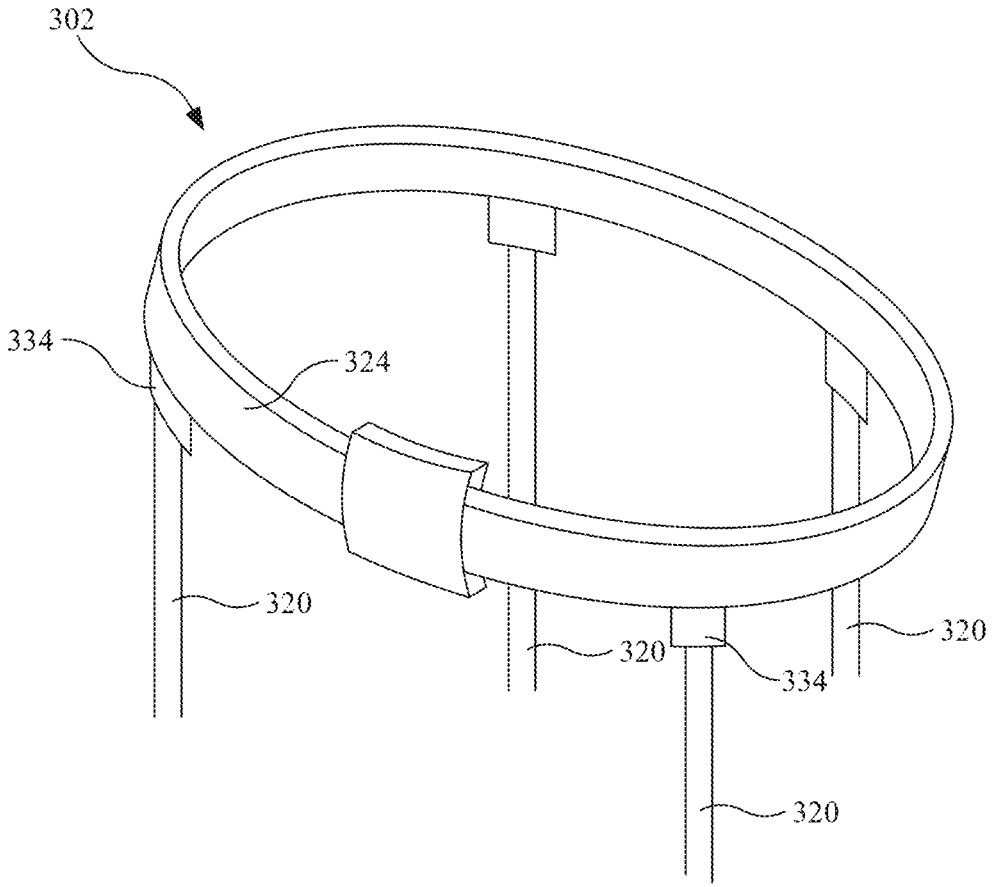
FIG. 10 is a perspective view of a belt illumination device according to another embodiment of the present invention.

FIG. 10 is a perspective view of a belt illumination device 302 according to another embodiment of the present invention. The belt illumination device 302 may be similar to belt illumination devices 102, 202. In the interest of brevity, similar aspects and alternatives will not be repeated. The belt illumination device 302 may include a belt portion 324 and illumination strands 320. The illumination strands 320 and the belt 324 may be separated by a non-strand portion 334. The non-strand portion 334 may be formed of wires run in a zigzag pattern within a stretchable fabric. Accordingly, the non-strand portion 334 may provide for maneuverability of the illumination strands relative to the belt 324 to further increase athlete comfort. Stated differently, the non-strand portions 334 may enable the illumination strands to stretch from and retract towards the belt.

In some embodiments, a belt illumination device may not include a traditional belt in the sense of the embodiments of FIGS. 4-6 and 10, but rather may include a wire portion connecting illumination strands to a power pack. In one embodiment, the power pack may be worn in a pocket of a track-mounted lower body garment. The wire portion may be permanently or removably incorporated into a waistband of a track-mounted lower body garment. The waistband may be formed of a stretch portion and the wire portion may be formed of a semi-flexible molded harness. The power pack, wire portion, and illumination strands may be formed as a unitary structure. In yet another alternative embodiment, the power pack, wire portion, and/or illumination strands may be removable from one another such as via plug and/or fastener assemblies.

Figure 11:
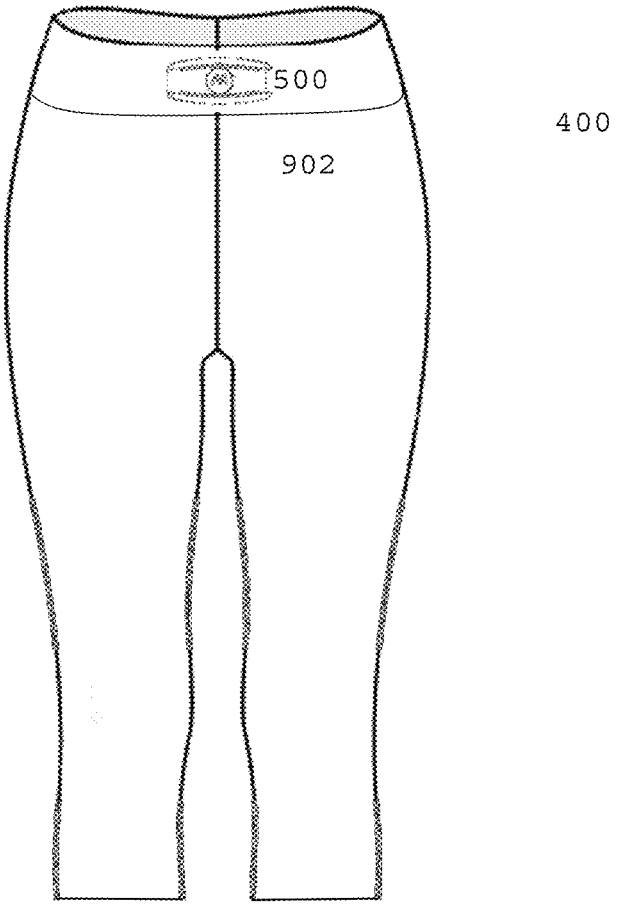
FIG. 11 is a perspective view of an athletic wear illumination system according to another embodiment of the present invention.

According to another exemplary embodiment, the power pack is a separate device which can be connected to at least one LED wire to illuminate a garment. For example, FIG. 11 is a perspective view of an athletic wear illumination system 400 according to another embodiment of the present invention. Aspects of the athletic wear illumination system 400 may be similar to the athletic wear illumination system 100 of FIG. 1. In the interest of brevity, similar aspects and alternatives will not be repeated. The athletic wear illumination system 400 may include a power pack 500 and an athletic wear garment 902. The power pack 500 may include one or more batteries to power one or more lights external to the power pack, a controller configured to control illumination of the one or more lights, and one or more contacts for electrically connecting the one or more batteries of the power pack to the one or more lights. The athletic wear garment 902 may include at least one illumination channel defined by a transparent or semitransparent upper layer and a fabric bottom layer. The at least one illumination channel may be configured to receive the one or more lights. The athletic wear garment 902 is configured to removably receive the power pack 500.

Figure 12A:
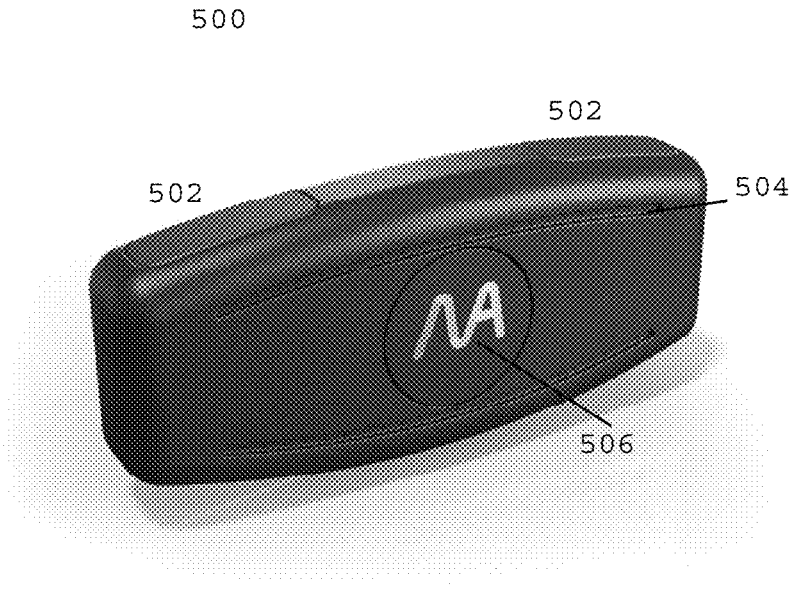
FIG. 12A is a perspective view of a power pack according to an embodiment of the present invention.
Figure 12B:
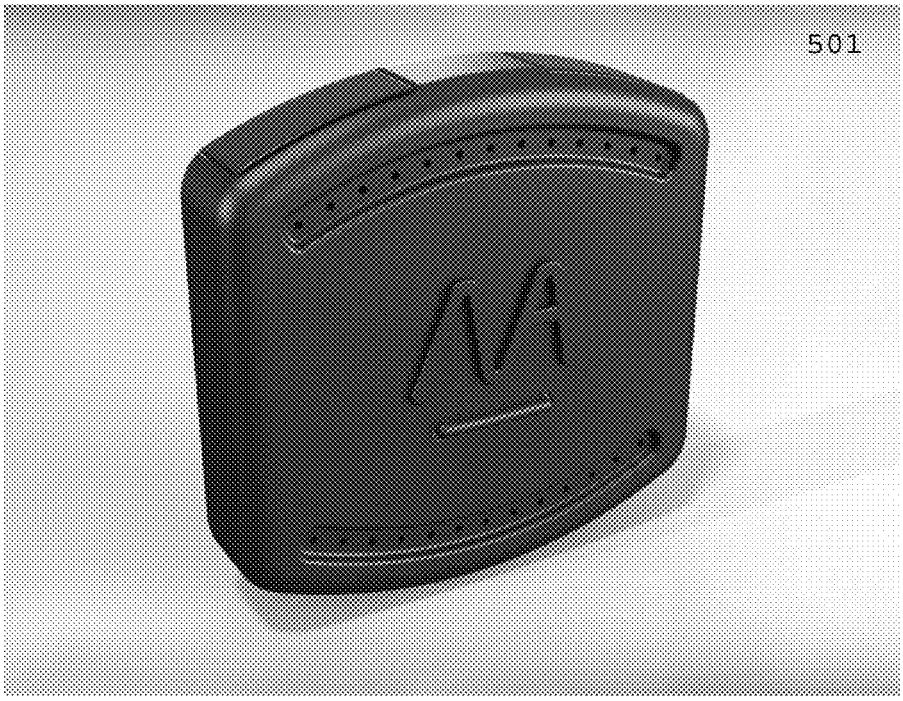
FIG. 12B is a perspective view of a power pack according to another embodiment of the present invention.

An exemplary power pack 500 is illustrated in FIG. 12A. In this example, power pack 500 may include panic buttons 502, speakers 504, and an on/off button 506. The power pack also may contain one or more batteries or other power sources. The power pack 500 may be in any shape or color. In the embodiment of FIG. 12A, the power pack 500 is generally rectangular in shape when viewed from the front. In the exemplary power pack of FIG. 12B, the power pack 501 is generally square in shape when viewed from the front. The particular shape may be configured for a particular activity, such as running or bicycling. The power pack may further be configured depending on desired battery characteristics, as discussed herein.

As illustrated in FIG. 12A, the power pack 500 may be 1 and ¼ inches tall (from the front) by 3 and ¼ quarter-inches wide, and may be formed of plastic. However, one of ordinary skill in the art will appreciate that dimensions and materials, like shape, may vary and may be configured for a particular activity. The panic buttons 502 may be located on the top of the power pack 500. The panic buttons 502 may be level with the top of the power pack 500 to prevent selection thereof. Alternatively, as least one panic button can be located on the top of the power pack 500 or panic buttons can be located on either, or each, side of power pack 500. An athlete could press one panic button to activate or could press both panic buttons simultaneously to activate. Further, in the example power pack 500, speakers 504 are located in the front of the power pack 500. The speakers allow for sound when at least one of the panic buttons 502 are pressed. Alternatively, the speaker holes could be located in the back of the power pack 500 or on top of the power pack 500, or located anywhere on the power pack 500. The speaker holes can comprise any number of holes in any type of design or pattern. In addition, pressing at least one of the panic buttons 502 may result in LEDs flashing, flashing different colors, or displaying a solid color. The on/off button 506 may be located on the front of the power pack 500. Alternatively, the on/off button 506 can be located on the bottom of the power pack 500 or any location on the power pack 500. Further, the on/off button 506 may be any size or shape. In some embodiments, the on/off button 506 may be illuminated in one or more colors. A pattern and or color of the illumination may communicate information regarding the condition of the battery. For example, the on/off button 506 may be illuminated in green when the battery is fully or mostly charged and red and or yellow as the charge of the battery decreases. Regarding the power pack and its components (e.g., the on/off button), the power pack 500 and its components may be provided in a waterproof casing to enable, e.g., night swimming in some embodiments.

Figure 13:
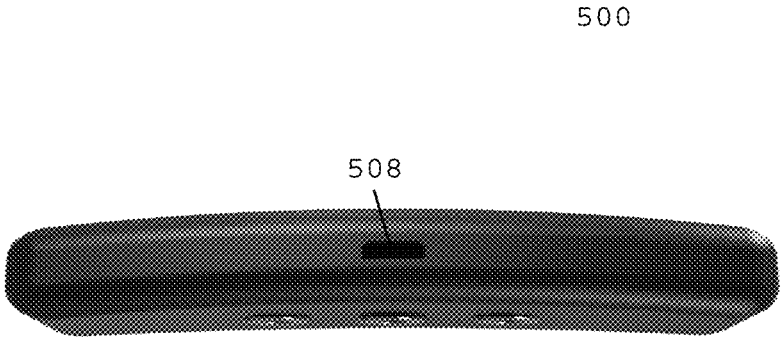
FIG. 13 is a bottom view of the power pack of FIG. 12A.

FIG. 13 shows a bottom view of the power pack 500. In this view, the power pack 500 includes a charging portal 508. Although illustrated as being on the bottom of the power pack 500, the charging portal 508 can be located on any part of the power pack 500. When viewed from the bottom (or the top), the power pack 500 has a slight curve configured to match the shape of an athlete. As noted above, the particular shape may take alternative configurations.

Figure 14:
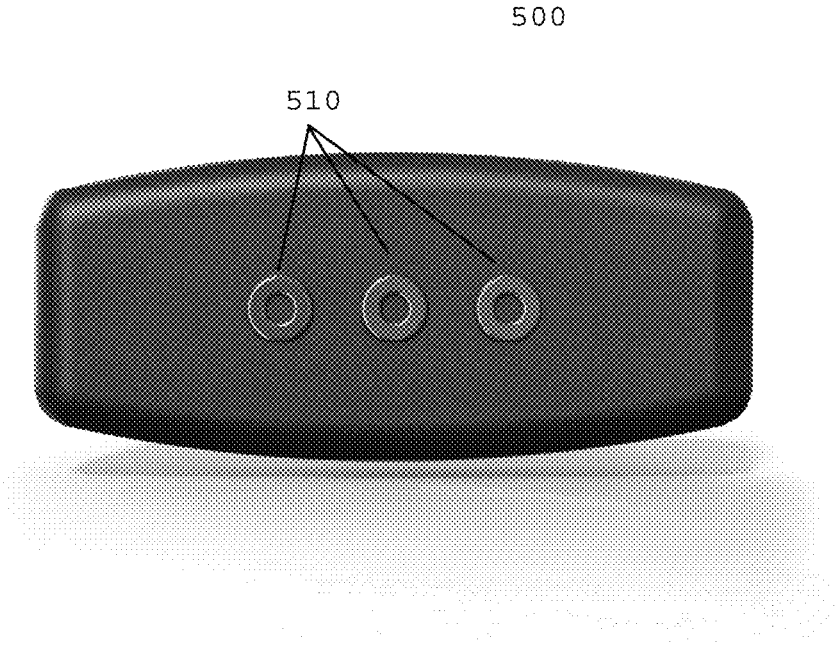
FIG. 14 is a rear view of the power pack of FIG. 12A.

FIG. 14 shows a back view of the power pack 500. In this view, the power pack 500 includes snaps 510 to complete the circuit of the power pack 500 when connected to the snap connectors in the power pack pocket discussed below. The snaps 510 can be located at any position of the power pack 500 and be of any size or shape.

Figure 15:
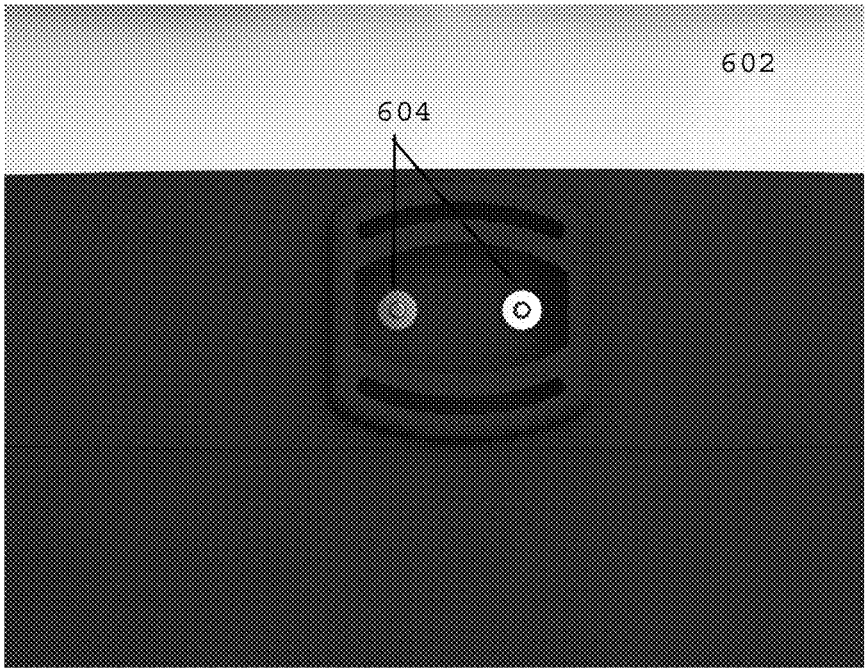
FIG. 15 is a perspective view of a power pack pocket according to an embodiment of the present invention.

FIG. 15 is a perspective view of a power pack pocket according to an embodiment of the present invention. According to an exemplary embodiment, power pack 500 or 501 may be configured to fit into a power pack pocket 602. In the embodiment shown in FIG. 15, the power pack pocket 602 corresponds to the power pack 501 of FIG. 12B. The power pack pocket 602 may be of any shape, size, or color. Further the power pack pocket 602 may be sewn into a garment or molded into a garment. The power pack 602 may be composed of any material. For example, the power pack pocket 602 may be made of plastic, fabric, or metal. However, the power pack pocket 602 is not limited to these materials. Further, in this exemplary embodiment as illustrated in FIG. 14, the power pack pocket 602 includes snap connectors 604 and speaker slots 606. As will be appreciated by one of ordinary skill in the art the power pack pocket 602 of FIG. 12B contains two snap connects for a design involving two snaps on the back of the power pack 501. A power pack pocket may contain a different number of snaps for a different configuration. For example, power pack 500 is shown in FIG. 14 as including three snaps for a circuit where LED lights are controlled by three wires. In this exemplary three snap embodiment, the power pack 500 can control the colors and/or flashing patterns of the one or more LED lights (or other lights) as described herein. The snap connectors 604 may be configured to connect to the snaps 510 of the power pack 500. The snap connectors 604 may be of any size, shape, or color. The speaker slots 606 may be configured to allow the speaker holes 504 of power pack 500 to be freely exposed. The speaker slots 606 may be of any shape or size. Further, a piece of Velcro® or hook and loop fastener, for example, can be used to hold the power pack 500 in place while encapsulated in the power pack pocket 602 to keep the power pack 500 from falling out of the power pack pocket 602.

Figure 16:
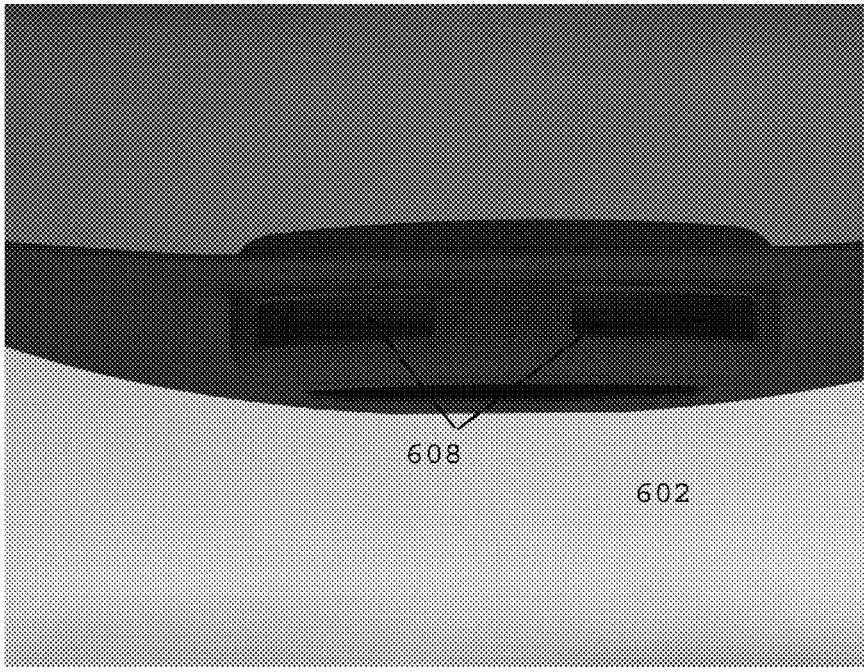
FIG. 16 is a top view of the power pack pocket of FIG. 15.

Another view of the power pack pocket 602 is shown in FIG. 16, where a top view of the power pack pocket 602 is provided. As shown in FIG. 16, the power pack pocket 602 includes slots 608 to allow the panic buttons 502 to be freely exposed for activation (by pressing, for example) by an athlete. The slots 608 can be of any shape or size.

Figure 17:
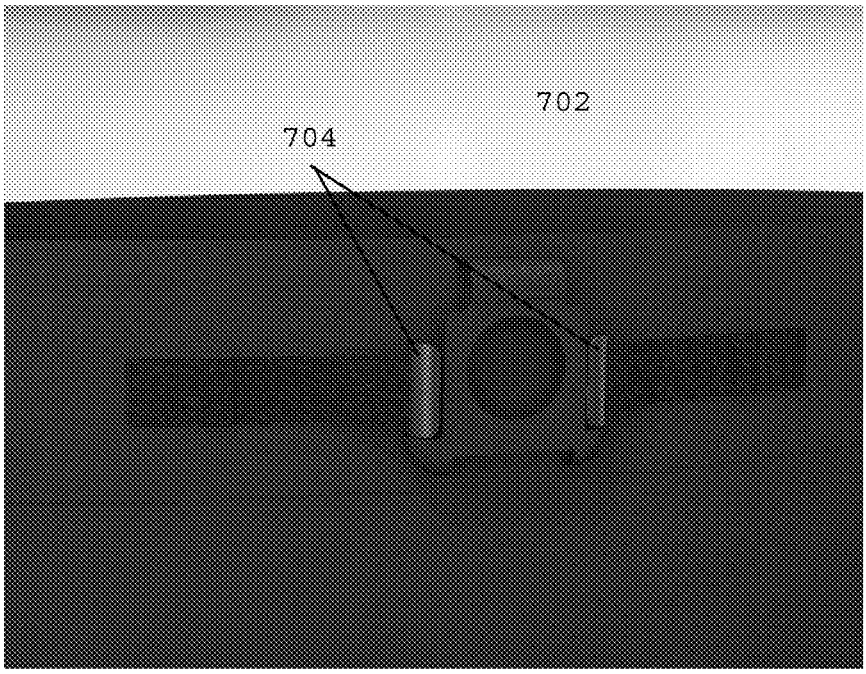
FIG. 17 is a perspective view of a power pack pocket according to another embodiment of the present invention.

According to another exemplary embodiment, the power pack 500 can be configured to fit into a power pack pocket 702, as shown in FIG. 17. In this exemplary embodiment, the power pack pocket 702 is configured to encapsulate the power pack 500. Instead, of using snaps to connect the power pack 500 to the circuit, in this example embodiment, the power pack 500 connects to clips 704 to connect the power pack 500 to the circuit. In this example, the clips 704 are attached to the covered wires which may extend and/or protrude from the waistband of an athletic garment. The covered wires may extend and/or protrude from any part of the garment. However, in this example embodiment as illustrated in FIG. 17, the covered wires extend and/or protrude from the waistband. The covered wires can be covered with any type of material, such as fabric or plastic, for example. Further, the covered wires can be of any color, shape, or size. Likewise, the power pack pocket 702 may be of any shape, color, or size. Further, a piece of Velcro®, for example, may be used to hold the power pack 500 in place while encapsulated in the power pack pocket 702 to keep the power pack 500 from falling out of the power pack pocket 702. Alternatively, alternative fastening and/or conductive structures (e.g., magnets) may be used in place or in addition to the snaps and snap connectors.

Figure 18:
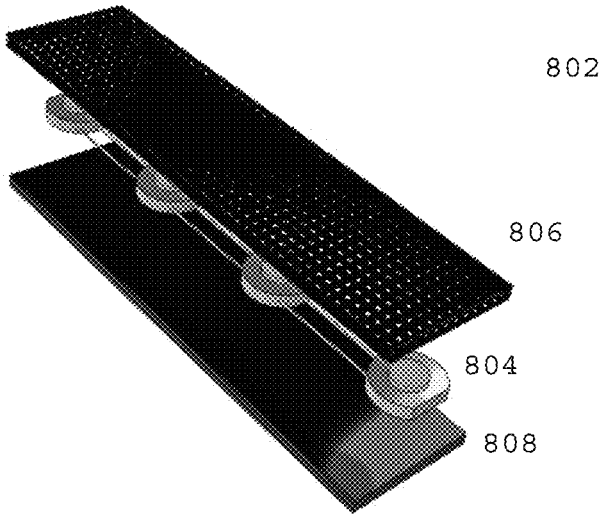
FIG. 18 is a perspective view of a channel according to an embodiment of the present invention.

According to an exemplary embodiment, garments can be illuminated by encapsulating at least one LED 804 in a channel 802 as shown in FIG. 18. As shown in this embodiment, the at least one LED 804 may be sandwiched between a bottom layer 808 and an upper layer 806. The sides of the LED 804 may be sewn to keep them in place between the bottom layer 808 and an upper layer 806. In other embodiments, the LED 804 can be LED strips or individually placed and sewn. In addition, the LED 804 can be individually placed to "pop through" a "button hole" of another layer, so that the LED 804 is exposed with no layer covering the LED 804. The LED 804 may form any pattern, and be of any color, shape, or size. The bottom layer 808 may be made of any material. The bottom layer 808 may be the material which forms the base of the athletic wear, so that the LED 804 does not directly touch an athletic wear user's skin. For example, the bottom layer 808 may be made of spandex and the athletic wear may be pants, capris, shorts, shirts, or sweatshirts and/or jackets. The upper layer 806 may also be made of any material, but is generally transparent, or semi-transparent to allow light to pass through and be seen. For example, the upper layer 806 may be made of a mesh material, where the mesh has holes in it to allow for the light to pass through when the illumination system is connected and is turned on. As discussed above, the materials may be any type of material and any color, shape, or size. For example, the LED lights may be multi-colored, colored, and/or clear. As other examples, fiber optic lights or electroluminescent lighting (EL) may be provided. By providing the LED or other lights, visibility of an athlete wearing the athletic wear illumination system 400, can be improved.

Figures 19A, 19B, 19C:
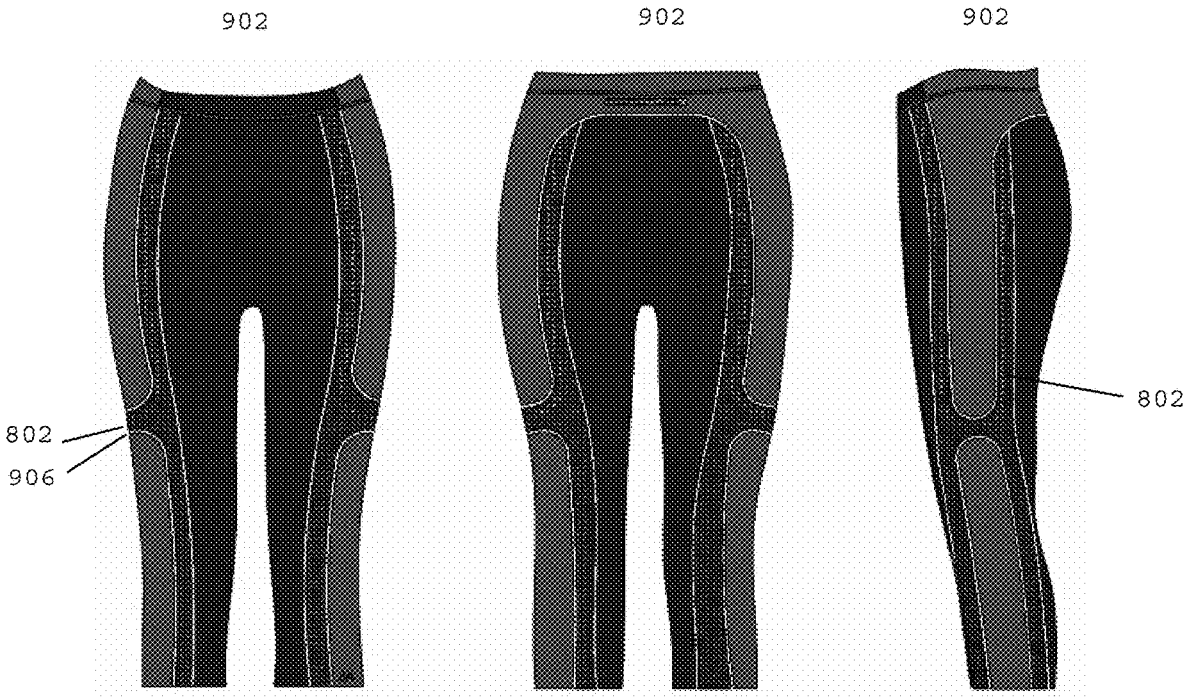
FIGS. 19A-19C are front, back, and side views of a garment according to an embodiment of the present invention.

FIGS. 19A-19C are front, back, and side views of a garment according to an embodiment of the present invention. According to this exemplary embodiment, the garment 902 may be a pair of capris. However, the garment may take the form of a pair of shorts or pants, or even a shirt or jacket. In this example illustration, four channels 802 run generally down the legs of the garment 902. In addition, connection channels 802 are shown running horizontally between two pairs of channels 802. However, as discussed above, the channel 802 (or channels) may be of any shape, size, color, or pattern. As shown in FIGS. 19A-19C, the channels are of multiple LED lights. Some or all of the LED lights may be illuminated. For example, as shown, LED lights running partially down the front of the legs, through the connection channels, and up the rear side of the legs may be illuminated while others are not. In addition, animated patterns may generated using illumination. As discussed herein, colors and/or a pattern indicating medical distress may be generated using selective illumination. Colors and or patterns may also indicate other conditions. For example, a condition of the battery (e.g., low charge, fully charged) may be communicated using selective illumination patterns and/or colors.

In addition to the LED lights, the garment 902 may include reflective trim 906, which can be of any color, shape, size, or pattern. In addition, the wires of the illumination system may meet in the waistband 904 so that the power pack 500 can be connected to the wires of the waistband 904 via a power pack pocket 602, for example.

Figure 20:
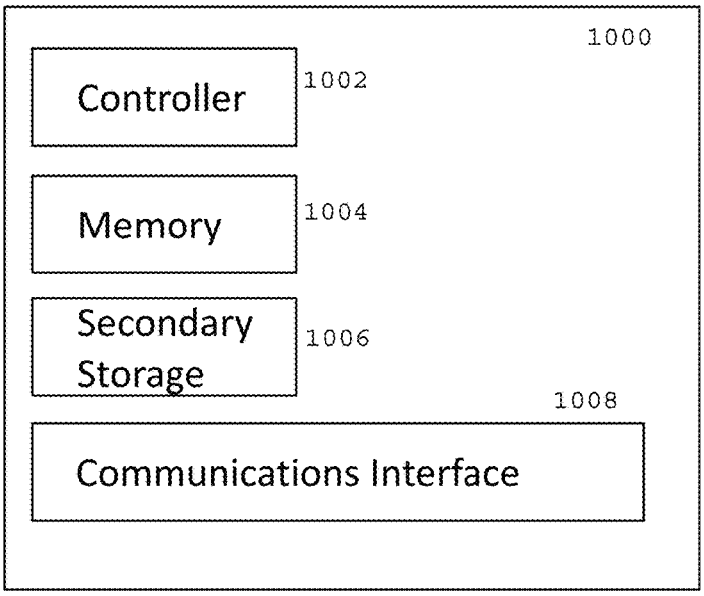
FIG. 20 is a schematic representation of a device which can perform the functions of a power pack according to exemplary embodiments of the present invention.

An exemplary device 1000 which can be used, for example, to act as the power pack 500, will now be described with respect to FIG. 20. The device 1000 may contain a controller 1002 (or multiple processor cores), e.g., an Intel CE 4100 chip, memory 1004, one or more secondary storage devices 1006 and an interface unit 1008 which can include one or more interfaces, e.g., analog, digital, wireless, such as Bluetooth® and the like, to facilitate communications between the device 1000 and other sources, such as a cell phone, the speakers, the charging portal, to another device 1000, to send instructions to the LEDs, or to automatically call emergency services. Hence, the interface unit 1008 may act as an input and/or an output to the speakers, a microphone, a display interface with a touchscreen, or other buttons. Instructions can be stored in either the memory 1004 or a secondary storage device 1006. Using stored information processor 1002 can send instructions to the LEDs, and perform other functions as described in the exemplary embodiments above. Thus, the device 1000 can include the necessary hardware and software to perform as the power pack 500.

In some embodiments, the power pack can be configured to communicate with other power packs, a cell phone, an emergency contact, or emergency services. For example, pressing of the panic button may send a signal to emergency services. Additionally, the power pack may include a global positioning system (GPS) so that emergency services could locate a wearer of the power pack. In an alternative embodiment, the interface unit 1008 may communicate with the athlete's cell phone so as to obtain GPS coordinates and/or communicate GPS coordinates when the panic button is selected. Moreover, the power pack may include a microphone to allow for sending spoken communications or other signals to another power pack or emergency services, for example. Likewise, the speakers on the power pack could act as receivers of communications or other signals from external sources, such as another power pack or emergency services, for example. Further, a corresponding software application may be executed, e.g., by the athlete's cell phone. The software application may communicate with the power pack 500 via the interface unit 1008. In one embodiment, a user of the software application may cause a command to be communicated to the power pack 500 that may cause the lights of the athletic wear garment to turn on or flash. For example, an athlete may turn-on the lights of the garment from the software application. As another example, a parent of a wearer of the garment may remotely cause the lights of the garment to flash signaling to the wearer to return home.

Embodiments of the present invention provide for illuminating athletic wear used by runners, walkers, bikers, and other athletes. Embodiments of the present invention may provide for a number of benefits, including providing battery powered illumination for athletes that is comfortable and easy to use for athletes as they exercise. Embodiments may be water resistant or waterproof, and a garment portion of the embodiments may be washable using a normal household clothes washers and clothes dryer. Embodiments of the present invention may be affordable as the belt illumination device or the power pack and the garment may be separate components and interchangeable, such that a user may have different styles and colors of garments that may be used with a single belt illumination device or power pack.

The foregoing description discloses only exemplary embodiments of the invention. Modifications of the above-disclosed embodiments of the present invention (beyond those modifications already mentioned) of which fall within the scope of the invention will be readily apparent to those of ordinary skill in the art. For instance, although in some embodiments, panic buttons are described, other panic selections may be used. For example, at least one switch or touch screen selection may be substituted for the buttons. As another example, although in some embodiments the power pack is described as plastic, other materials may be used. For example, light-weight aluminum may be substituted for the power pack.

Accordingly, although embodiments of the present invention have been shown and described, it would be appreciated by those skilled in the art that changes may be made in these embodiments without departing from the principles and spirit of the invention.

The invention claimed is:

1. An athletic wear illumination system, comprising:

a removable power pack including one or more batteries to power a plurality of lights external to the removable power pack including a water resistant or waterproof housing, a controller configured to control illumination of the plurality of lights, and one or more contacts for electrically connecting the one or more batteries of the removable power pack to the plurality of lights; and an athletic wear garment including two leg portions, the athletic wear garment comprising at least one selected from the group of pants, shorts, and capris, the athletic wear garment including at least two illumination paths, the at least two illumination paths each being configured to receive one or more of the plurality of lights, wherein the removable power pack is disposed outside of the athletic wear garment, wherein one of the at least two illumination paths extends downward along a first of the two leg portions of the athletic wear garment, and wherein a different one of the at least two illumination paths extends downward along a second of the two leg portions of the athletic wear garment, wherein the athletic wear garment is configured to removably receive the removable power pack by one or more fasteners of the athletic wear garment configured to receive and secure the removable power pack when removably received by the athletic wear garment, the one or more fasteners of the athletic wear garment comprising at least one selected from the group of magnetic connectors and clip connectors, wherein the one or more of the plurality of lights of each of the at least two illumination paths of the athletic wear garment are configured to be operably connected to the removable power pack when the removable power pack is removably received by the athletic wear garment by the one or more fasteners of the athletic wear garment, and wherein the one or more of the plurality of lights of each of the at least two illumination paths of the athletic wear garment are configured not be operably connected to the removable power pack when the removable power pack is not received by the athletic wear garment by the one or more fasteners of the athletic wear garment.

2. The athletic wear illumination system of claim 1, wherein the removable power pack further comprises a panic selection, and wherein, upon activation of the panic selection when the removable power pack is removably received by the athletic wear garment by the one or more fasteners of the athletic wear garment, the controller is further configured to illuminate the plurality of lights in a flashing pattern and/or combination of colors indicative of athlete distress.

3. The athletic wear illumination system of claim 2, wherein the removable power pack further comprises one or more speakers, and wherein, upon activation of the panic selection when the removable power pack is removably received by the athletic wear garment by the one or more fasteners of the athletic wear garment, the controller is further configured to cause the one or more speakers to emit an alarm and/or siren in conjunction with the illumination of the one or more lights in the flashing pattern and/or combination of colors indicative of athlete distress.

4. The athletic wear illumination system of claim 2, wherein the removable power pack further comprises a mobile device interface, and wherein the controller is further configured to interface with a Global Positioning Satellite (GPS) enabled mobile device to log and/or transmit GPS coordinates of the mobile device upon selection of the panic button when the removable power pack is removably received by the athletic wear garment by the one or more fasteners of the athletic wear garment.

5. The athletic wear illumination system of claim 1, wherein the plurality of lights are part of a plurality of light strips.

6. The athletic wear illumination system of claim 5, wherein the light strips are each sewn or affixed as a layer between a transparent or semitransparent upper layer and a fabric bottom layer.

7. The athletic wear illumination system of claim 6, wherein a fabric bottom layer is constituted by a fabric of the athletic wear garment.

8. The athletic wear illumination system of claim 1, wherein the athletic wear garment further comprises reflective trim.

9. The athletic wear illumination system of claim 1, wherein the one of the at least two illumination paths extends downward along a first portion of the first of the two leg portions of the athletic wear garment and upward along a second portion of the first of the two leg portions, and wherein the different one of the at least two illumination paths extends downward along a first portion of the second of the two leg portions of the athletic wear garment and upward along a second portion of the second of the two leg portions.

10. The athletic wear illumination system of claim 1, wherein the one of the at least two illumination paths is U shaped and wherein the different one of the at least two illumination paths is U shaped.

11. The athletic wear illumination system of claim 1, wherein the athletic wear garment is configured to removably receive the removable power pack along a waistband of the athletic wear garment.

12. An athletic wear illumination system removable power pack, comprising:

one or more batteries to power a plurality of lights external to the removable power pack, wherein the removable power pack includes a water resistant or waterproof housing, the plurality of lights configured to be along at least two paths of an athletic wear garment including two leg portions, the athletic wear garment comprising at least one selected from the group of pants, shorts, and capris, each path extending downward along one of the two leg portions of the athletic wear garment, wherein the removable power pack is disposed outside of the athletic wear garment;

a controller configured to control illumination of the plurality of lights; and one or more contacts for electrically connecting the one or more batteries to the plurality of lights, wherein the removable power pack is configured to be removably received by the athletic wear garment by one or more fasteners of the athletic wear garment configured to receive and secure the removable power pack when removably received by the athletic wear garment, the one or more fasteners of the athletic wear garment comprising at least one selected from the group of magnetic connectors and clip connectors.

13. The athletic wear illumination system removable power pack of claim 12, wherein the removable power pack further comprises a panic selection, and wherein, upon activation of the panic selection, the controller is further configured to illuminate the plurality of lights in a flashing pattern and/or combination of colors indicative of athlete distress.

14. The athletic wear illumination system removable power pack of claim 13, wherein the removable power pack further comprises one or more speakers, and wherein, upon activation of the panic selection, the controller is further configured to cause the one or more speakers to emit an alarm and/or siren in conjunction with the illumination of the one or more lights in the flashing pattern and/or combination of colors indicative of athlete distress.

15. The athletic wear illumination system removable power pack of claim 13, wherein the removable power pack further comprises a mobile device interface, and wherein the controller is further configured to interface with a Global Positioning Satellite (GPS) enabled mobile device to log and/or transmit GPS coordinates of the mobile device upon selection of the panic button.

16. An athletic wear illumination system garment including two leg portions, the athletic wear illumination system garment comprising:

at least two illumination paths, a removable power pack including a water resistant or waterproof housing, wherein the athletic wear illumination system garment comprises at least one selected from the group of pants, shorts, and capris, wherein one of the at least two illumination paths extends downward along a first of the two leg portions, and wherein a different one of the at least two illumination paths extends downward along a second of the two leg portions, wherein the athletic wear illumination system garment is configured to removably receive the removable power pack by one or more fasteners of the athletic wear garment configured to receive and secure the removable power pack when removably received by the athletic wear garment, the one or more fasteners of the athletic wear garment comprising at least one selected from the group of magnetic connectors and clip connectors, wherein the removable power pack is disposed outside of the athletic wear garment, wherein the one or more of a plurality of lights of each of the at least two illumination paths of the athletic wear garment are configured to be operably connected to the removable power pack when the removable power pack is removably received by the athletic wear garment by one or more electrical connectors, and wherein the one or more of the plurality of lights of each of the at least two illumination paths of the athletic wear garment are configured not to be operably connected to the removable power pack when the removable power pack is not received by the athletic wear garment by the one or more electrical connectors.

17. The athletic wear illumination system garment of claim 16, wherein the one or more lights of each path are part of a light strip.

18. The athletic wear illumination system garment of claim 17, wherein the light strip of each path is sewn or affixed as a layer between a transparent or semitransparent upper layer and a fabric bottom layer.

19. The athletic wear illumination system garment of claim 18, wherein the fabric bottom layer is constituted by a fabric of the athletic wear illumination system garment.

20. The athletic wear illumination system garment of claim 16, further comprising reflective trim.

* * * * *